United States Patent [19]

Barthruff et al.

[11] 4,251,788

[45] Feb. 17, 1981

[54] ELECTROMAGNETIC SOLENOID OPERATED SWITCH, PARTICULARLY STARTER SWITCH FOR AUTOMOTIVE ENGINES

[75] Inventors: Otto Barthruff, Stuttgart; Martin Mayer, Sersheim; Martin Sprenger, Vaihingen, all of Fed. Rep. of Germany

[73] Assignee: Robert Bosch GmbH, Stuttgart, Fed. Rep. of Germany

[21] Appl. No.: 58,073

[22] Filed: Jul. 16, 1979

[30] Foreign Application Priority Data

Aug. 12, 1978 [DE] Fed. Rep. of Germany ..... 2835407

[51] Int. Cl.[3] ..... H01H 3/60

[52] U.S. Cl. ..... 335/157; 335/131; 335/193

[58] Field of Search ..... 335/157, 193, 262, 168, 335/131, 264

[56] References Cited

U.S. PATENT DOCUMENTS 3,047,690 7/1962 Sprague et al. ..... 335/157

3,273,086 9/1966 Eberline et al. ..... 335/157

3,848,206 11/1974 Prouty et al. ..... 335/193

*Primary Examiner*—Harold Broome

*Attorney, Agent, or Firm*—Frishauf, Holtz, Goodman & Woodward

[57] ABSTRACT

To reliably hold a movable contact bridge carrier on a longitudinally slidable contact stem in position, even though subjected to severe vibration and shock, while still permitting free longitudinal movement of the stem carrying the contact carrier, the stem is passed through an opening formed in the magnetic yoke of the operating solenoid, and a clamping bushing, for example of tough, elastically deformable plastic, such as nylon, is placed in position to surround the stem where it passes through the opening, the bushing having spreader elements which extend radially outwardly to resiliently bear against the inner surface of the opening, the spreader elements merging into a cylindrical portion of the bushing surrounding the stem to hold the stem in centered, vibration and shock-absorbing position within the opening in which it is longitudinally movable.

9 Claims, 5 Drawing Figures

ELECTROMAGNETIC SOLENOID OPERATED SWITCH, PARTICULARLY STARTER SWITCH FOR AUTOMOTIVE ENGINES

The present invention relates to an electromagnetically operated switch, and more particularly to a starter switch for internal combustion engines, and especially to starter switches for automotive-type engines, which are subject to shock and vibration when associated with a vehicle.

BACKGROUND AND PRIOR ART

Starter switches typically are relays in which a contact carrier, upon energization of a solenoid, is moved from a quiescent or OFF position in electrical contact relation with fixed terminals. In one form of such a switch, the contact carrier is a bridge-type contact which connects two respectively insulated switch terminals. A contact spring presses the contact bridge carrier against the fixed contacts, when energized. When in quiescent or OFF condition, a return spring holds the contact bridge carrier in retracted position, away from the fixed contacts. The contact bridge, typically, is secured to a contact carrier stem which, in turn, is attached to a magnetically responsive armature which, in quiescent condition, is pulled by a spring away from the position into which it is moved upon energization of the solenoid winding. To provide for secure engagement of the bridge, a bridge holding spring is provided between the contact bridge carrier and the armature of the solenoid. By suitable dimensioning of the springs, the quiescent condition of the movable portions of the switch can usually be maintained quite well; the severe environmental operating conditions to which such switches are exposed, however, when installed in automotive vehicles may cause the contact carrier to move in spite of the presence of the springs, that is, the springs cannot ensure the accurate positioning of the armature, and the carrier stem as well as the contact carrier alone. To prevent spurious engagement, the travel of the armature, and hence of the contact bridge is usually selected to be comparatively long. Starter switches, especially, are used only for very short periods of time during the operation of the motor vehicle, that is, they are usually in the OFF position since their ON position is required only during starting of the engine. It is thus desirable to ensure proper positioning of the contact bridge for the entire life of the switch.

THE INVENTION

It is an object to provide a switch construction in which the movable portions of the switch are reliably held in OFF position unless energized, and still are freely movable when energized to turn the switch ON, in spite of subjection of the switch to vibration, shock, wide temperature swings and temperature gradients.

Briefly, a radially resiliently deflectable bushing, preferably of plastic, is positioned within the relay, surrounding the stem which connects the armature of the solenoid to the contact bridge. One of the springs within the relay bears against the cylindrical portion of the bushing which, preferably, is formed with axial longitudinal slits at the portion opposite the cylindrical portion against which the spring bears, the slits providing for axially extending portions which bear against the contact bridge, which may include its holding elements, the radially diverging portions being formed as radially spreading tines which can bear against the inner surface of a guide opening in a guide element within the switch structure. The bushing is preferably so constructed that the axially extending portions which connect the cylindrical part, and hence the contact carrier pressure spring to the contact carrier, are slightly longer than radially spread-apart portions. The bushing is axially slidable on the contact carrier stem to permit resilient engagement of the contact carrier with the fixed contacts of the relay itself, when engaged, and also to permit over-travel of the stem itself.

The bushing, which in its preferred form is made of a tough plastic, such as nylon or the like, retains the contact stem, resiliently supported, within the guide opening. The guide opening preferably is formed in the return yoke of the solenoid itself. The element, particularly when made of a tough plastic, is an inexpensive component, the assembly of which introduces hardly any additional costs to the overall structure, while reliably holding the movable components within the relay in fixed relative position in spite of the presence of severe vibration and shock loading.

Drawings, illustrating a preferred example, wherein.

Figure 1:
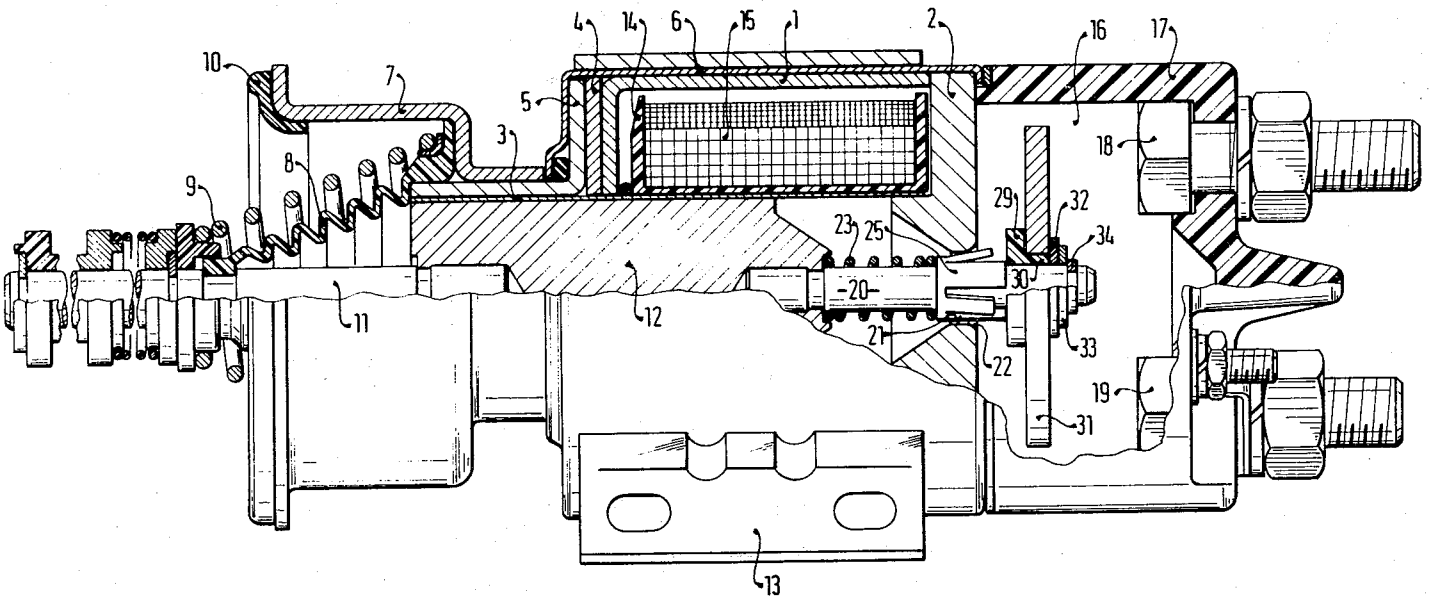
FIG. 1 is a longitudinal view of a starter relay for an automotive engine, partly broken away and in section, and illustrating those components necessary for an understanding of the present invention.

The starter relay has a cup-shaped yoke 1, with an end face formed partly of the magnetic core element 2. A brass sleeve 3 fits against an inner end of the yoke 2, the other end of the brass sleeve extending beyond the axial extent of the solenoid coil and outwardly of the yoke 1. A disk 4 and a guide sleeve 5 are axially stacked at the back of the in-turned portion of the yoke 1. The disk 4 and the sleeve 5 are secured together by an outer housing portion 6, the edges of which extend over the core 2, being flanged thereto at one end, and on the other over the guide sleeve 5. A bearing bushing 7 engages the guide sleeve 5. A sealing bellows 8 is sealingly located within the bushing 7, held in position by one end of a return spring 9. A sealing ring 10 is provided to seal the assembly to a drive bearing, not shown, with which the solenoid can be used. The bellows 8 and the return spring 9 have their other end connected to an armature operating rod 11, secured to the armature 12 of the solenoid. The armature 12 is guided within the brass sleeve 3. The return spring 9 tends to hold the armature 12 in the position shown in FIG. 1, which is the quiescent or OFF position of the switch. Suitable dust sealing rings and the like can be used, not further described in detail, since they form no part of the present invention, although shown in the drawing. An attachment flange 13 is secured to the housing 6 in order to attach the switch to the housing of the starter motor, not shown.

A winding form 14 is located within the return yoke 1, carring two windings, forming a pull-in winding and a holding winding; the windings may also be formed as a single tapped winding, or only a single winding may be used, in accordance with the design requirements of the starting circuit of the motor.

The right facing portion of the core part 2 of the magnet, as seen in FIG. 1, defines one end of a switching chamber 16, closed off by a cap 17 of insulating material. The cap 17 is secured in well-known manner, not shown, to the housing 6. The cap carries two main current contacts 18, 19 which extend into the switching chamber 16, and which have connecting bolts extending outwardly therefrom.

The armature 12 of the solenoid carries a switching stem 20 at the side remote from the operating bolt 11. The switching stem 20 extends through a longitudinal bore or opening 21 in the magnetic core portion 2 and into the switching chamber 16. The bore 21 is enlarged to funnel-shape or to form a conical depression at the side facing the armature 12 which, in turn, is formed with a conical projection to fit within the depression of the core element 2. The corner surrounding the opening within the part 2 is rounded or chamfered as seen at 22. The diameter of the longitudinal bore 21, in its cylindrical portion, is substantially greater than the diameter of the switching stem 20.

The switching stem 20 carries a contact pressure spring 23, one end of which engages the armature 12, the other end of the contact spring 23 resiliently supports a contact bridge 31 which, when the relay is ON, bridges the gap between the fixed contacts 18, 19.

Figure 3:
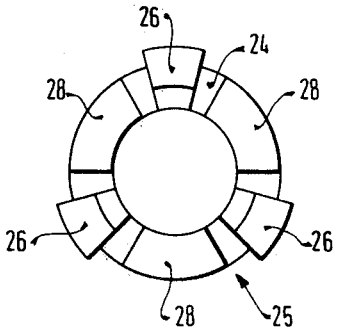
FIG. 3 is a view of the bushing of FIG. 2 taken along arrow III.
Figure 2:
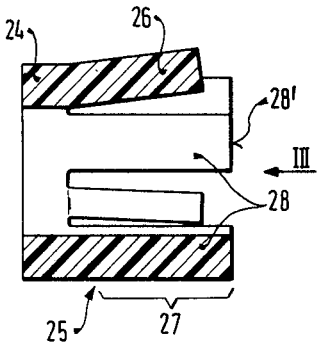
FIG. 2 is an axial sectional view, greatly enlarged, of a clamping bushing made of plastic.

In accordance with the present invention, a bushing of resilient, tough thermoplastic material 25 surrounds the switching stem 20. The bushing 25 has a cylindrical portion 24 (FIG. 2) which is engaged by the spring 23. The bushing 25, additionally, has a portion 27 which is longitudinally slotted, to form longitudinally cylindrically extending segments 28, and radially spread segments 26 (FIGS. 2, 3). The bushing 25 is longitudinally slidable on the stem 20. The bushing 25, in the OFF position as shown in FIG. 1, extends into and through the opening 21, the portion 27 thereof extending into the switching chamber 16.

The contact assembly includes a contact bridge carrier 29 of insulating, preferably plastic material, which is slidable on the stem 20. The contact bridge carrier 31 is located on a cylindrical, axially extending bushing portion 30 of the carrier 29. An insulating disk 32, a washer 33, and a holding ring 34, which is engaged in a groove of the stem 20, for example a C-ring, connects the contact carrier 31 to the stem 20, while permitting axial slidable movement with respect thereto.

The resilient, tough elastic plastic bushing 25 has three circumferentially uniformly positioned axially spread tine-like segments 26 which alternate with the cylindrical portions 28. The segments 26 are spread outwardly at an acute angle with respect to the longitudinal axis of the stem 20, and hence of the bushing 25. They are of uniform size throughout their length. The length of the segments 26 is slightly less than the cylindrical segments 28 which have their end surfaces 28' in engagement with the carrier bushing 29 of the contact element 31. This relieves the axially outwardly spread segments 25 from axial pressures since the axial force of the spring 23 will be transferred to the contact bridge 31 through the cylindrical portion 24 and the end surfaces 28' of the cylindrically extending segments 28.

Operation: The switch, as illustrated in FIG. 1, is in the de-energized or OFF position. Upon connecting the winding 15 to a suitable source of electrical power, for example the battery of an automotive vehicle, armature 12 is pulled into alignment with the winding 15 to the extent possible, that is, towards the right counter the force of the return spring 9. The switching stem 20 moves toward the right, spring 23 pushing the bushing 25 which, in turn, pushes the contact carrier 31, 29 towards the fixed terminals 18, 19. Upon engagement of the terminals 18, 19 by the contact bridge 31, spring 23 can compress upon further movement towards the right of the armature 12. This permits relative sliding movement of the switching stem 20 with respect to the bushing 25 and the contact bridge carrier 29. The spring 23 maintains the contact bridge 31 in resilient engagement with the fixed contacts 18, 19. Upon engagement or close proximity of the armature 12 with the core 2, the bolt 11 has also moved towards the right to an extent which permits engagement of a starter gear pinion with the starter gear of the internal combustion engine. The electrical circuit is closed between the fixed contacts 18, 19 by the bridge 31.

When the engine has started, current to the winding 15 of the switch is interrupted. The armature 12 is rapidly pulled away by the return spring 9 from the core 2. Simultaneously, the switching stem 20 moves to the left, the washer arrangement 32, 33, 34 engages, upon leftward movement, the contact bridge 31 and its carrier 29 and, upon further movement towards the left of the armature 12, the stem 20 and the contact bridge 31 are severed from the fixed contacts 18, 19. The armature 12 returns the stem 20 to its quiescent position, and the contact spring 23 presses the contact bridge carrier 29 and with it the contact bridge 31, as well as the bushing 25 into the quiescent position, as shown in FIG. 1.

When the armature 12 and the switching stem 20 attached thereto have returned to their quiescent or OFF position, the bushing 25 will clamp the stem 20 at the rounded edge 22 of the bore or opening 21 of the core portion 2, primarily by the radially outwardly resiliently extending tines or segments 26 thereof. The bridge 31 is thus retained in fixed position, protected against vibration and shock. Likewise, the armature 12 is securely held between the springs 23 and 9, with the axial and radial position clearly defined by the bushing 25 blocked within the opening 21 by the radially resiliently deflectable segments 26.

Figure 5:
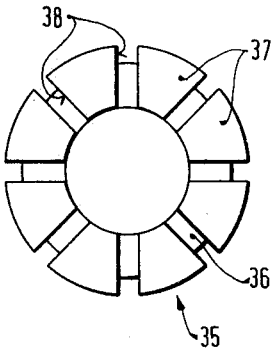
FIG. 5 is an end view taken along the arrow V of FIG. 4.
Figure 4:
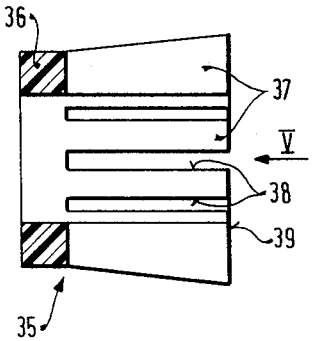
FIG. 4 is a cross-sectional view of another embodiment of the bushing.

Various changes and modifications may be made in the construction of the bushing 25. FIGS. 4 and 5 illustrate another embodiment. The bushing 35 has a cylindrical portion 36, engaged by the spring 23. The segments 37 extend from the cylindrical portion 36, the segments 37 being separated from each other by slits 38. The inner diameter of the segments 37 is the same as the inner diameter of the cylindrical bushing 36. In longitudinal section, however, the segments 37 are trapeze-shaped—see FIG. 4. The cross-sectional area of the segments 37 uniformly decreases from the end face 39 to the cylindrical portion 36. The bushing 35 is longitudinally slidable on the switching stem 20, similar to the bushing 25 (FIGS. 1, 2, 3). It is movable between the contact spring 23 and the carrier 29 of the contact bridge 31.

In quiescent or OFF position of the switch, the segments 37 clamp the stem 20 within the opening 21, and specifically at the rounded or chamfered edge 22 of the opening 21 within the core portion 2. This, again, retains the stem 20 in resilient, properly axially aligned position, even in the presence of severe shock or vibration, while permitting axial sliding movement of the stem 20, and movement of the bushing 25 out of the opening 21 under pressure of the spring 23.

Various other changes and modifications may be made, and features described in connection with one of the embodiments may be used with the other, within the scope of the inventive concept.

We claim:

1. Automotive starter switch having a housing (1, 17);

fixed contact means (18, 19) insulated from each other, secured in the housing;

a solenoid (1, 15) located within the housing and having a movable armature (12) guided within the solenoid for longitudinal movement toward and away from said fixed contact means;

a contact stem (20) carried by said armature;

movable contact means (29-31) carried by said contact stem to engage said fixed contact means upon energization of the solenoid;

spring means (9, 23) biassing the armature, and the movable contact means carried thereby away from the fixed contact means;

and a guide element (2) within the housing formed with a guide opening (21) therein to guide the contact stem upon reciprocating movement of the armature, and comprising, in accordance with the invention, a resiliently deformable clamping bushing means (25, 35) located on the contact stem and movable with respect thereto, said bushing means comprising an essentially cylindrical portion (24, 36) surrounding the contact stem and fitting within the opening (21) and the guide element (2), resiliently deflectable and radially outwardly divergent spreader element (26, 37) projecting in axial direction from said cylindrical portion;

and axial positioning means (27, 28; 38) positioning said bushing partly within said opening when the solenoid is deenergized to permit the radially resilient portions to accurately and securely hold the stem in position within the opening even in the presence of shock or vibration.

2. Switch according to claim 1, wherein the spring means include a spring (23) bearing againt the cylindrical portion (24, 36) of said clamping bushing means (25, 35);

and the axial positioning means comprises axially extending portions (27, 37, 38) projecting from said cylindrical portion and bearing against said movable contact means (29–34).

3. Switch according to claim 2, wherein the clamping bushing means comprises a material of tough, elastic plastic.

4. Switch according to claim 2, wherein (FIG. 2) the bushing positioning means comprises axially extending portions (28) fitting around said stem, and said axially extending portions and the radially outward spreader elements have essentially the same radial dimension.

5. Switch according to claim 4, wherein the spreader element and the axially extending portions are alternately, circumferentially located around the stem, and integral with the essentially cylindrical portion (24);

and the radially outwardly divergent spreader elements have an axial length which is less than the axial length of the axially extending portions (28).

6. Switch according to claim 1, wherein (FIGS. 4, 5) said radially outwardly diverging spreader elements and said positioning means comprises unitary axially extending tine-like elements which, in axial cross section, are essentially trapeze-shaped, having an inner surface essentially fitting around the contact stem (20) and an outer surface which tapers or diverges outwardly from the essentially cylindrical portion.

7. Switch according to claim 6, wherein the inner diameter of the unitary spreader elements and positioning means and the inner diameter of the essentially cylindrical portion is the same.

8. Switch according to claim 5, wherein the clamping bushing means comprises a material of tough, elastic plastic.

9. Switch according to claim 6, wherein the clamping bushing means comprises a material of tough, elastic plastic.

* * * * *